362-213 SR
4/23/87 03 4,661,891

United States Patent [19]
Kitamura

[11] Patent Number: 4,661,891
[45] Date of Patent: Apr. 28, 1987

[54] DECORATIVE HANGING LIGHTING APPARATUS

[75] Inventor: Masaharu Kitamura, Ohtsu, Japan

[73] Assignee: Kuroi Garasu Kougyo Co., Ltd., Kyoto, Japan

[21] Appl. No.: 783,932

[22] PCT Filed: Feb. 6, 1985

[86] PCT No.: PCT/JP85/00049

§ 371 Date: Sep. 27, 1985

§ 102(e) Date: Sep. 27, 1985

[87] PCT Pub. No.: WO85/04703

PCT Pub. Date: Oct. 24, 1985

[30] Foreign Application Priority Data

Apr. 4, 1984 [JP] Japan ..... 59-49803[U]

[51] Int. Cl.[4] ..... F21S 3/00

[52] U.S. Cl. ..... 362/219; 362/223; 362/225; 362/227; 362/396

[58] Field of Search ..... 362/219, 223, 225, 227, 362/396, 806

[56] References Cited

FOREIGN PATENT DOCUMENTS 46-771 1/1971 Japan .
55-15607 4/1980 Japan .

*Primary Examiner*—Carroll B. Dority, Jr.
*Attorney, Agent, or Firm*—Koda and Androlia

[57] ABSTRACT

This invention relates to decorative hanging lighting apparatuses adapted to be hung from the ceiling, etc., and comprised of a plurality of lighting units coupled in the vertical direction. In the aforementioned lighting unit, for facility in coupling lighting units and for obviating the wiring work, there are provided two hooking members each having hooking means at both ends thereof and formed of an electric conductor, with electrode wires of an electric bulb or electric bulbs connected respectively to the aforementioned two hooking members. The top hooking means of one of the aforementioned lighting units are hooked on the bottom hooking means of the aforementioned other lighting unit which is placed above the former lighting unit, to couple these lighting units, thereby comprising the aforementioned decorative hanging lighting apparatus.

7 Claims, 24 Drawing Figures

DECORATIVE HANGING LIGHTING APPARATUS

TECHNICAL FIELD

This invention relates to decorative hanging lighting apparatuses having arbitrary numbers of lighting units coupled in the vertical direction, which are used mainly for decoration of common home entrances and parlors or hotels' lobbies, etc.

BACKGROUND ART

Heretofore, decorative hanging lighting apparatuses having a plurality of lighting units vertically coupled to arbitrary lengths have been widely used in hotels' lobbies, etc. In a representative apparatus, the whole of the lighting apparatus is supported by the ceiling, such that the hooking fixture which has a high enough strength to support the weight of the apparatus is fixed to the ceiling by means of screws, etc.; to this hooking fixture, first, a first lighting unit is fixed and then, to this lighting unit, a second lighting unit and further, if necessary, a third lighting unit is fixed to the second unit and then, a fourth unit to the third one. After the necessary number of lighting units are fixed in this way, wiring work is done on each lighting unit. In conducting this work, draw out two power supply lines through the aforementioned hooking fixture and electrically connect them by way of soldering to the power supply terminals of the lamp inside the first lighting unit. Then, the power supply terminals inside the second lighting unit are electrically connected by power supply lines. Further, similarly, the power supply terminals inside the N-th lighting unit and the power supply terminals inside the N+1-th lighting unit are electrically connected.

In the aforementioned conventional decorative hanging lighting apparatuses, parts for fixing the necessary number of lighting units were utilized and the work for fixing them was very confusing.

Besides, even after the lighting units have been fixed, because the wiring work for making electrical connection between each two lighting units is indispensable, the whole of the work is confusing and takes trouble and moreover, it is not easy to change the number of lighting units used. Furthermore, the difficulty in concealing the power supply lines from outside results in untoward appearance.

The object of this invention is to provide decorative hanging lighting apparatuses in which coupling of each two lighting units can be very readily made, number change can be made at once and wiring work is entirely obviated; besides, power supply lines which impair their appearance are absent.

DISCLOSURE OF INVENTION

The present invention is characterized in that two hooking members each equipped at both ends with hooking means and composed of a conductor are provided in the aforementioned lighting unit; electrode wires are joined to respective two hooking members above-mentioned, and that the hooking means at the top of one lighting unit are hooked on the hooking means at the bottom of the other lighting unit.

In this structure, the coupling of each two lighting units is completed merely by hooking the hooking member of each lighting unit on the hooking member of the lighting unit just above the respective unit. Besides, since the hooking members themselves are conductors and hooking members of each two lighting units are electrically connnected to each other, the wiring work is obviated.

MODES FOR EXERCISING THE INVENTION

Figure 1:
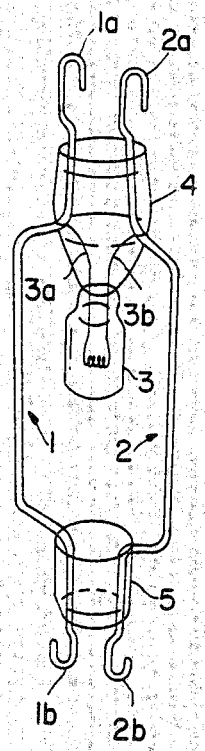
FIG. 1 is an appearance sketch of a lighting unit of a decorative lighting apparatus, a preferred embodiment of this invention.

FIG. 1 is an appearance sketch of a single lighting unit of a decorative hanging lighting apparatus, a preferred embodiment of this invention. Numerals 1 and 2 denote hooking members each of a conductor and with both ends bent in an angle shape, forming hooking means 1*a*, 1*b*, 2*a* and 2*b*. To the aforementioned hooking members 1 and 2, electrode wires 3*a* and 3*b* of an electric bulb 3 are respectively linked, so that there are electrical continuity between them. These hooking members 1 and 2 and the electrode wires 3*a* and 3*b* are fixed with transparent insulating fixing members 4 and 5 to be symmetrically in place to right and left, without being electrically short-circuited.

Figure 2:
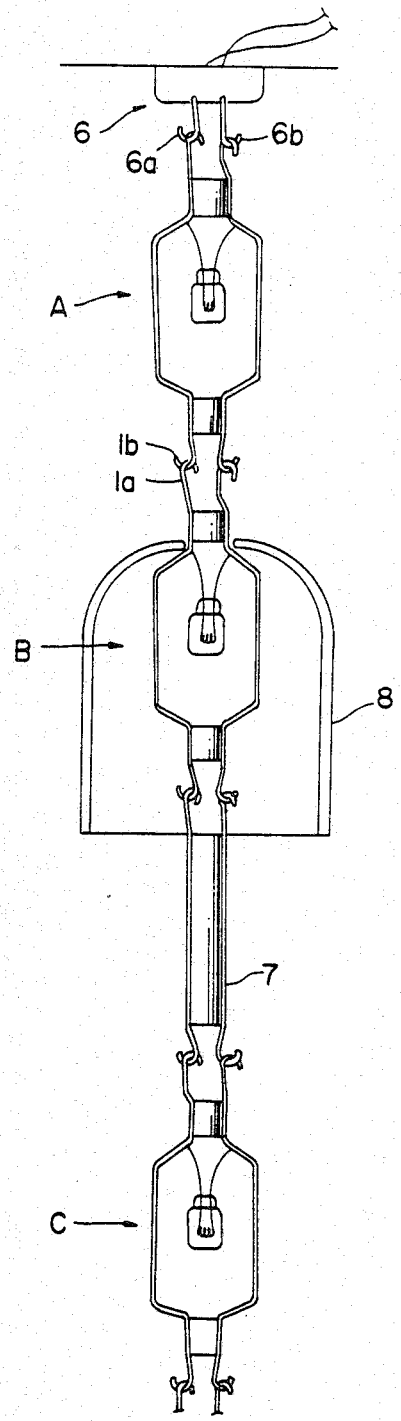
FIG. 2 is an appearance view of a lighting apparatus having a plurality of the aforementioned lighting units coupled by hooking.

FIG. 2 is an appearance view of a lighting apparatus having a plurality of the aforementioned lighting units coupled by hooking. To hooking means 6*a* and 6*a* of a hooking fixture 6 attached to the ceiling, a voltage (about 12 V is considered appropriate) is supplied. To these means, the lighting units A, B and C shown in FIG. 1 are coupled by hooking. The hooking means 1*a* and 2*a* of the lighting unit A supply power to the electric bulb 3 by being hooked on the aforementioned hooking means 6*a* and 6*b*, thereby not only getting it lit, but conducting the source voltage to the hooking means 1*b* and 2*b*. Accordingly, the lighting unit which is hooked on the hooking means 1*b* and 2*b* of the lighting unit A through its hooking means 1*a* and 2*a* is likewise lit and the voltage is conducted to 1*b* and 2*b*. The lighting unit C also operates likewise.

As shown in FIG. 2, by inserting a spacer 7 between two lighting units, the distance between these lighting units may be freely set and an accessory 8, etc., shown by broken lines in this figure may be attached merely by putting it on the lighting unit.

Figure 3:
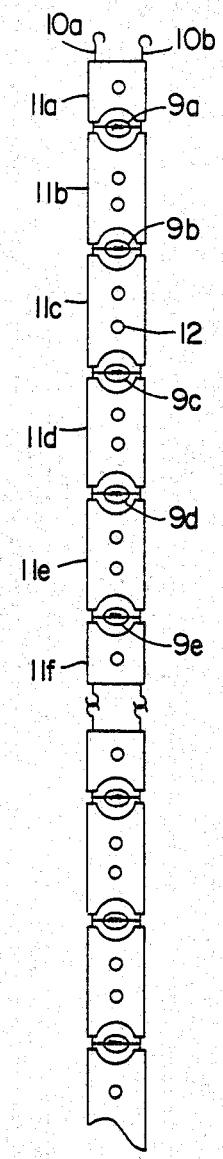
FIG. 3 is an appearance view of a second embodiment.
Figure 4:
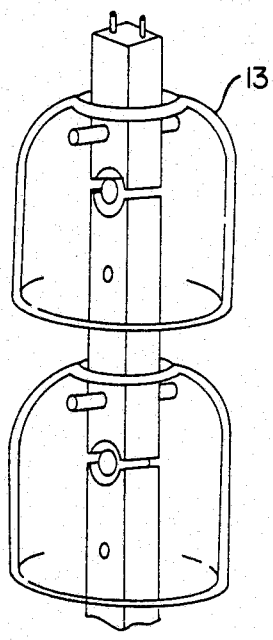
FIG. 4 is a structure view showing the state of the aforementioned second embodiment on which accessories are attached.

FIG. 3 is a view showing a second embodiment of this invention. In each lighting unit, five electric bulbs 9*a*, 9*b*, 9*c*, 9*d* and 9*e* are mounted and the hooking members 10*a* and 10*b* are coated by insulating fixing members 11*a*, 11*b*, 11*c*, 11*d*, 11*e* and 11*f*, except for the hooking means. And with pins inserted through small holes respectively opened in the aforementioned insulating fixing members, accessories 13 may be hung thereon, as shown in FIG. 4.

Figure 5:
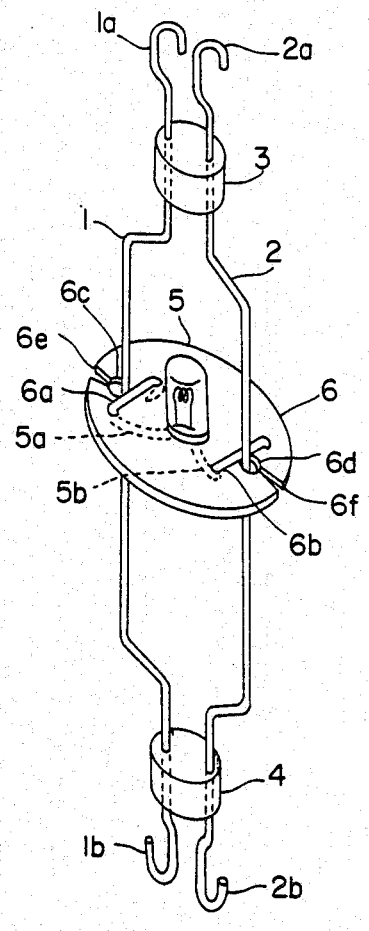
FIG. 5 is an appearance sketch of a single lighting unit of a decorative hanging lighting apparatus, a third embodiment of this invention.

FIG. 5 is an appearance sketch of a single lighting unit of a decorative hanging lighting apparatus, a third embodiment of this invention. Numerals 1 and 2 denote hooking members each of a conductor and being bent in an angle shape at both ends, forming hooking means 1*a*, 1*b*, 2*a* and 2*b*. These two hooking members are fixed near their hooking means with insulating fixing means 3 and 4, to be symmetrical to right and left and without being electrically short-circuited. A sliding plate 6 of an insulating and elastic material having an electric bulb 5 securely mounted thereon and conductors 6*a* and 6*b* arranged thereon in such a way as to allows its electrode wires 5*a* and 5*b* to be electrically conducting with the hooking members 1 and 2 is held vertically slidably between the members 3 and 4. What fundamentally differentiates this embodiment from that shown in the aforementioned FIG. 1 rests with this part. Thus this sliding plate 6 has not only nearly a circular shape, but has two sliding holes 6*c* and 6*d* adjacent to its periphery for passage of the hooking members 1 and 2 therethrough, permitting the plate's up-down sliding on these hooking members. Besides, by disposing the conductors 6*a* and 6*b* in proximity to these sliding holes 6*c* and 6*d*, the conductors 6*a* and 6*b* are brought in contact with the hooking members 1 and 2. Since in this embodiment, the sliding holes 6*c* and 6*d* are opened by notching from the periphery of the sliding plate, the sliding plate 6 may be readily detached by tilting the sliding plate 6 in such a way as to allow the hooking members 1 and 2 to be clear through the groove 6*a* and 6*f* which were formed when notching out the holes.

Figure 6:
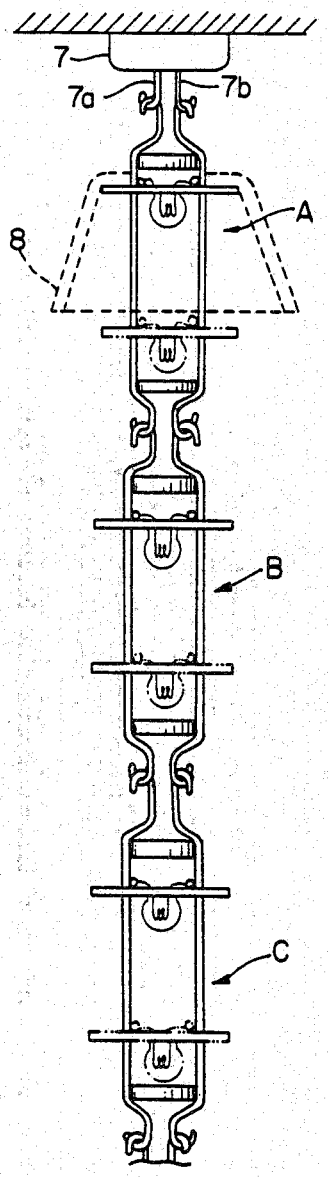
FIG. 6 is an appearance view of a lighting apparatus having a plurality of the aforementioned lighting units coupled by hooking.
Figure 7:
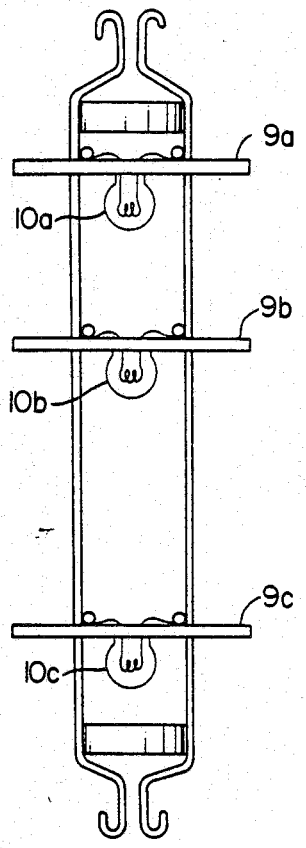
FIG. 7 is an appearance view of a lighting unit showing the state of it being provided with a plurality of sliding plates.

FIG. 6 is an appearance view of a lighting apparatus having a plurality of the aforementioned lighting units coupled by hooking, in which a voltage (about 12 V is considered appropriate) is supplied to the hooking means 7*a* and 7*b* of the hooking fixture 7 which is attached to the ceiling. To these means, the lighting units A, B and C shown in FIG. 5 are coupled by hooking. The upper hooking means 1*a* and 2*a* of the lighting unit A supply power to the electric bulb 5 by being hooked on the aforementioned hooking means 7*a* and 7*b*, thereby getting it lit. And the source voltage is conducted to the bottom hooking means 1*b* and 2*b*. Accordingly, the electric bulb 5 of the lighting unit B hooked on the bottom hooking means of the lighting unit A through its top hooking means 1*a* and 2*a* is similarly lit and the voltage is conducted to 1*b* and 2*b*. And the lighting unit C also operates similarly. The sliding plate 6 may be slid from the position shown by real line in FIG. 5 to the position shown by two dots and one dash alternating line, enabling the distance between light sources to be freely set, without using a spacer, etc. Besides, the illuminating light may be altered by covering the sliding plate 6 with an accessory 8, etc., as shown by broken lines in this figure. On the other hand, FIG. 7 shows a lighting unit provided with three sliding plates 9*a*, 9*b* and 9*c* on which electric bulbs 10*a*, 10*b* and 10*c* are respectively securely held. In this way it is possible to attach to a single lighting unit several sliding plates on each of which an electric bulb is securely held.

In this way, according to this embodiment, it is possible to freely alter the distance between light sources by moving the sliding plates and enjoy variation of design in wide range of freedom through combination of some accessories, etc.

Figure 8:
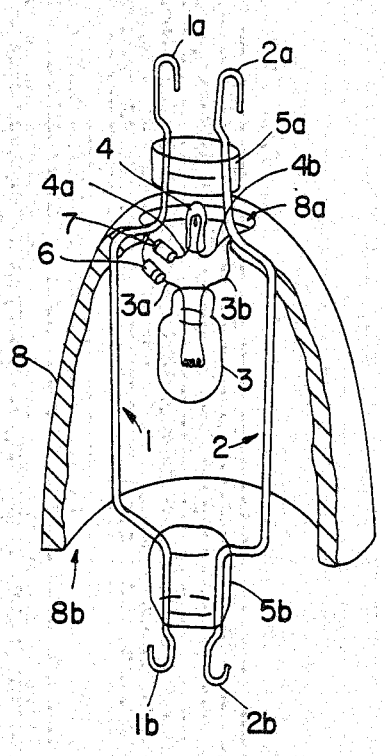
FIG. 8 is a partly broken appearance view of a lighting unit of a decorative hanging lighting apparatus, a fourth embodiment of this invention.

FIG. 8 is a partly broken appearance sketch of a lighting unit of a decorative hanging lighting apparatus, a fourth embodiment of this invention. Numerals 1 and 2 designate hooking members each of a conductor and being bent at both ends, forming hooking means 1*a*, 1*b*, 2*a* and 2*b*. To the aforementioned hooking member 1, one of electrode wires 3*a* of the electric bulb 3 is linked through a diode 6, while one of electrode wires 4*a* of the electric bulb 4 is connected thereto through another diode 7. The aforementioned diodes 6 and 7 are connected mutually in opposite directions, forming part of the lighting switching device to be described later. To the hooking member 2, are connected to the other electrode wires 3*b* and 4*b* of the two electric bulbs 3 and 4. And the two hooking members 1 and 2 are securely held in place and symmetrically to right and left by transparent insulating fixing members 5*a* and 5*b*, without being electrically short-circuited. The distance between the hooking members are widened between the upper and the lower fixing members 5*a* and 5*b* and the opening part 8*a* at the top of the bell shape glass globe 8 is sized nearly equal to the outer circumference of the fixing member 5*a*. By passing the lighting unit from the bottom opening part 8*b* of the glass globe 8 to the top opening part 8*a*, the glass globe 8 is held by the part of the hooking members 1 and 2 of the lighting unit where the distance between them is widened. Of the two electric bulbs connected to the hooking members, the upper electric bulb 4 is located at the top opening part 8 of the glass globe 8 and by lighting this electric bulb 4, it is possible to get the glass globe shine.

Figure 9:
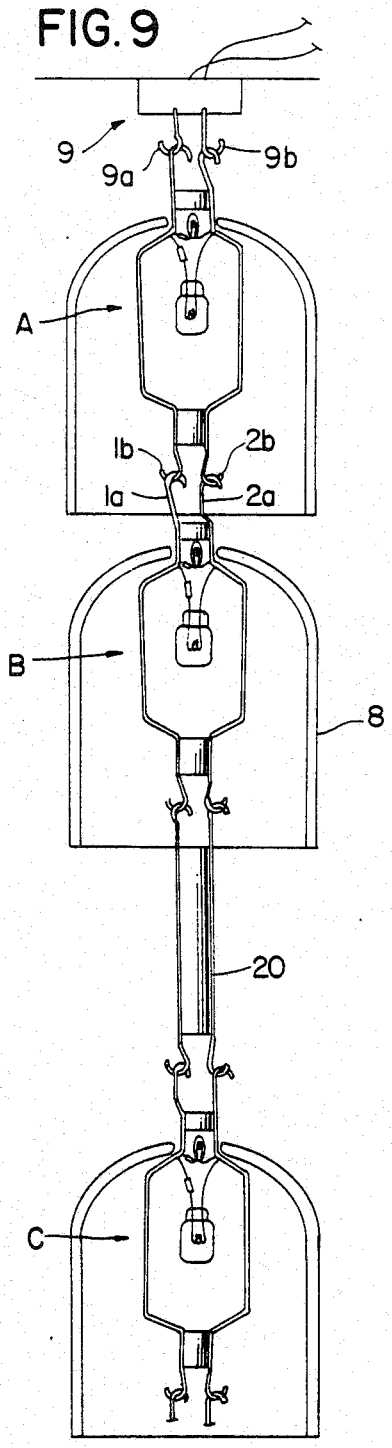
FIG. 9 is an appearance view of a lighting apparatus having such lighting units coupled by hooking.

FIG. 9 is an appearance view of a lighting apparatus having a plurality of the aforementioned lighting units coupled by hooking. To the hooking means 9*a* and 9*b* of a hooking fixture 9 attached to the ceiling, is supplied a voltage (about 12 V is considered appropriate). To this hooking means 9a and 9b, the lighting units A, B and C shown in FIG. 8 are coupled by hooking. With the hooking means 1a and 2a of the lighting unit A hooked on the aforementioned hooking means 9a and 9b, power is supplied to the electric bulbs 3 and 4, thereby getting them lit, while the source voltage is conducted to the hooking means 1b and 2b. Accordingly, the lighting unit B which is hooked on the hooking means 1b and 2b of the lighting unit A through its hooking means 1a and 2a is also lit up, while the voltage is conducted to 1b and 2b. Then the lighting unit C also similarly operates. Besides, by inserting a spacer 20 between the lighting units, as shown in this figure, the distance between the lighting units may be freely set.

Figure 10A:
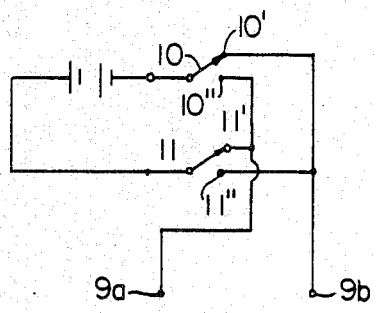
FIGS. 10(A)–(C) are diagrams showing electric wirings for this lighting unit and the lighting switching devices used therefor.
Figure 10B:
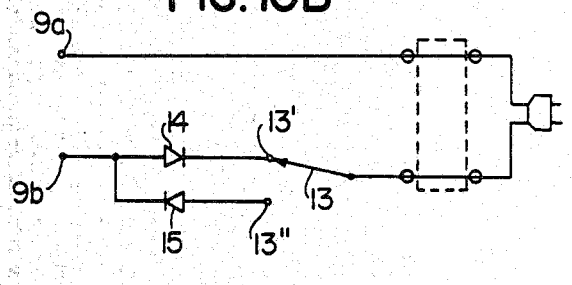
Figure 10C:
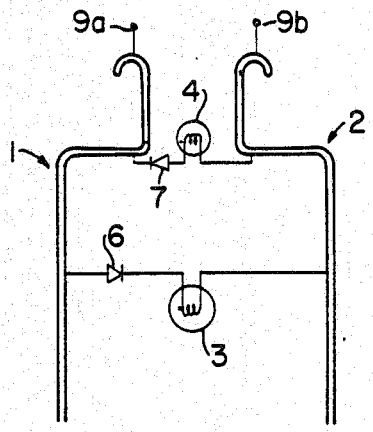

FIG. 10 gives diagrams showing wirings in decorative hanging lighting apparatus, a fourth embodiment of this invention, FIG. 10(A) showing wirings of a lighting switching device for use with DC power source. FIG. 10(B) wirings of a lighting switching device for use with AC power source, and FIG. 10(C) a diagram showing wirings for a lighting unit. When a DC power source is used, wirings are provided as shown in FIG. 10(A) and the switches 10 and 11 are interlocked and are in contact with 10' and 11'; then, the 9a side becomes + in polarity and the 9b side − accordingly, the side of the hooking member 1 of the lighting unit shown in FIG. 10(C) becomes +, causing the diode 6 connected thereto to be driven conductive and thereby, the electric bulb 3 to be lit. When the switches 10 and 11 are connected to 10" and 11" in the wiring system shown in FIG. 10(A), the 9a side becomes − in polarity and the 9b side +, so that the hooking member 2 becomes +, causing the electric bulb 4 to be lit. When an AC power source is utilized, as shown in FIG. 10(B), a switch 13 is provided in one of the power supply lines with two diodes 14 and 15 placed behind its contacts 13' and 13" and wirings so provided as to connect them in opposite directions to each other. With these wire connections, when the switch 13 is connected to 13', the electric bulb 3 is lit in the arrangement of FIG. 10(C), but when the switch 13 is connected to 13", the electric bulb 4 is lit.

In this way, the illuminating light may be altered by getting lit either one of two electric bulbs in this embodiment, whereby the design of the lighting apparatus and the illumination light image may be changed.

Figure 11:
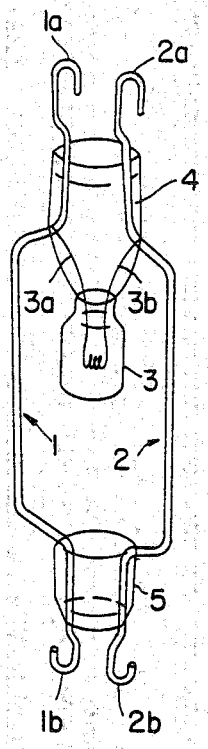
FIG. 11 is an appearance view of a lighting unit of a decorative hanging lighting apparatus, a fifth embodiment of this invention.

FIG. 11 is an apparatus sketch of a lighting unit of a decorative hanging lighting apparatus, a fifth embodiment of this invention. Numerals 1 and 2 are hooking members each composed of a conductor and being bent in an angle shape at both ends to form hooking means 1a, 1b, 2a and 2b. To the aforementioned hooking means 1 and 2, are connected electrode wires 3a and 3b of an electric bulb 3 which are thus also electrically rendered conductive. These hooking members 1 and 2 and electrode wires 3a and 3b are electrically fixed by transparent insulating fixing members 4 and 5 in positions symmetrical to right and left, without being electrically short-circuited. The construction of the lighting unit of this embodiment is quite identical with that shown in FIG. 1.

Figure 12:
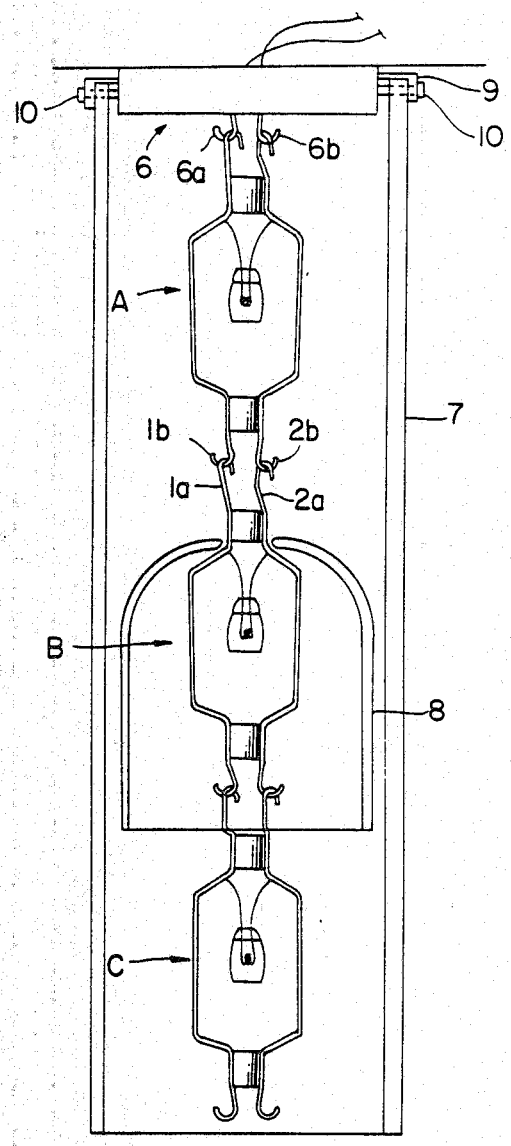
FIG. 12 is a sketch partly in section of this decorative hanging lighting apparatus.

FIG. 12 is an appearance view of a lighting apparatus having a plurality of the aforementioned lighting units coupled by hooking. To hooking means 6a and 6b of a hooking fixture attached to the ceiling, a voltage (about 12 V is considered adequate) is supplied from a power source. To this means, lighting units A, B and C shown in FIG. 11 are coupled by hooking. The hooking means 1a and 2a are hooked on the aforementioned hooking means 6a and 6b. The power is supplied to the electric bulb 3, thereby to get it lit and moreover, the source voltage is supplied also to the hooking means 1b and 2b. Accordingly, the lighting unit B which is hooked on the bottom hooking means 1b and 2b of the lighting apparatus unit A through its hooking means 1a and 2a is similarly lit and the voltage is conducted to 1b and 2b. The lighting unit C also operates similarly. Further, these coupled lighting units A–C are covered with a glass pipe 7. On the opening part of this glass pipe 7, a disk shape fitting 9 having at its center an aperture nearly equal to the external dimension of the aforementioned hooking fixture 6 is fitted, with its outer circumferential rim bent downward. A small hole opened near the upper opening part of the glass pipe 7, a small hole opened in the bent part of the fitting 9 and the screw hole tapped in the hooking fixture 6 in a position corresponding to these holes, on one side of the hooking fixture, are aligned and a mounting screw is passed from outside through them and screwed into the fixture, thereby securely holding the glass pipe 7 in a position where it covers and protects the coupled lighting units. The provision of this glass pipe 7 differentiates this apparatus from that shown in FIG. 2.

It is possible to modify the illumination light by providing whatever pattern to this glass pipe. Or the accessory shown in this figure may be attached by merely putting it on the hooking members. In this structure, the aforementioned glass pipe also serves as a protector of this accessory.

As hereabove-described, according to this embodiment, it is possible to protect the coupled lighting units, facilitate their cleaning, rectify their posture even when they are tilted and moreover, provide any modifications in the illumination light.

Figure 13:
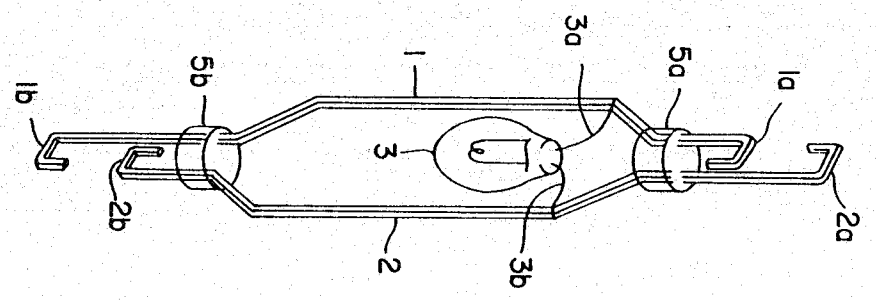
FIG. 13 is an appearance view of a lighting unit of a decorative hanging lighting apparatus, a sixth embodiment of this invention.

FIG. 13 is an appearance view of a single lighting unit which composes a decorative hanging lighting appearance, a sixth embodiment of this invention.

A single lighting unit is composed of two hooking members 1 and 2, fixing members 5a and 5b and an electric bulb 3. The hooking members 1 and 2 are each composed of a conductive material and have top hooking means 1a and 2a and bottom hooking means 1b and 2b at both ends, which are placed respectively on a common plane. The fixing members 5a and 5b are composed of an insulating material and are holding the aforementioned two hooking members securely in place, keeping them apart from each other. And the two electrode wires of the electric bulb 3 are respectively joined to the hooking members 1 and 2. The top hooking means 1a of the hooking member 1 is formed by bending at 90 degrees the end part of the hooking member at two positions. The bottom hooking means 1b is formed by bending the bottom end part of the hooking member 1 in a shape symmetrical to the aforementioned top hooking means 1a. Further, in the hooking member 1, the distance between the top hooking means 1a and the fixing member 5a is set about one half the distance between the bottom hooking means 1b and the fixing member 5b. The hooking member 2 is a conductor formed in the same shape as the hooking member 1, which is arranged in up-side-down relation to the hooking member 1 and they are facing each other. Thus in a lighting unit, the top and the bottom hooking members are formed symmetrically about the center of the lighting unit. In coupling the lighting units composed as hereabove-described, it is possible to hook the top hooking means 1a and 2a of the lower lighting unit on the bottom hooking means 1b and 2b of the upper lighting unit by turning the lower lighting unit 90° from the upper lighting unit.

Figure 14:
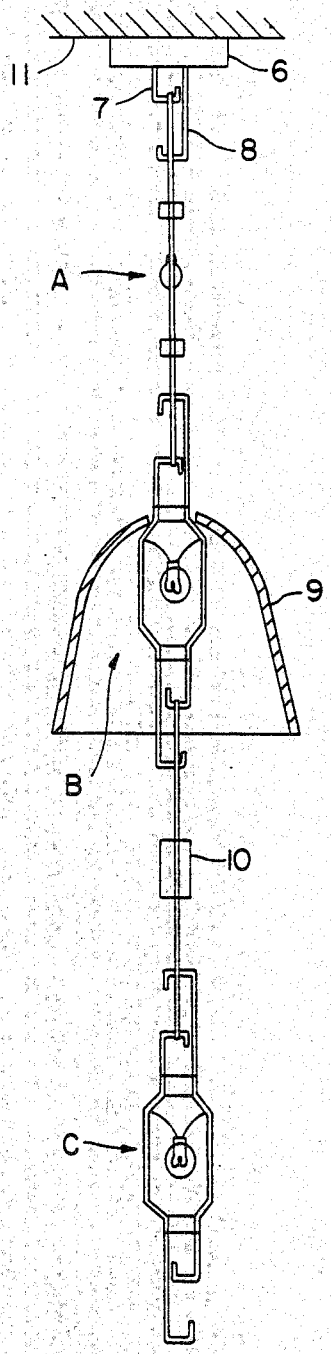
FIG. 14 is a view illustrating a construction of this decorative hanging lighting apparatus.

FIG. 14 is a view illustrating one of constructions of decorative hanging lighting apparatus having the aforementioned lighting units coupled together.

To the hooking means 7 and 8 of the hooking fixture 6 attached to the ceiling, a voltage (about 12 V is considered appropriate) is supplied from a power source not shown in this drawing. To the aforementioned hooking means 7 and 8, the lighting units A, B and C shown in FIG. 13 are coupled by hooking. With the top hooking means 1a and 2a of the lighting unit A hooked on the hooking means 7 and 8, current is supplied to the electric bulb 3 of the lighting unit A, thereby getting it lit, while the source voltage is led to the bottom hooking means 1b and 2b. In that way, the current is similarly supplied to the electric bulb 3 of the lighting unit B which is coupled to the lighting unit A by hooking its upper hooking means 1a and 2a on the lighting unit A's bottom hooking means 1b and 2b, thereby getting the bulb lit, while the source voltage is led to its bottom hooking means 1b and 2b. Thus as hereabove described, the source voltage supplied to the hooking means 7 and 8 is conducted through the hooking members of each lighting unit, enabling the current to be supplied to electric bulbs of all coupled lighting units, to get them lit up.

According to this embodiment, since the hooking parts formed at both end parts of the hooking member are in the same shape, the manufacturing process of the lighting unit is simplified and it has become possible that the cost is cut down and that the shape of the hooking part of the lighting unit is made compact, resulting in improvement in workability, by arranging two hooking members with their respective hooking means vertically shifted from one another and placing respective hooking members on a common place. Further the packaging volume is reduced.

Figure 15:
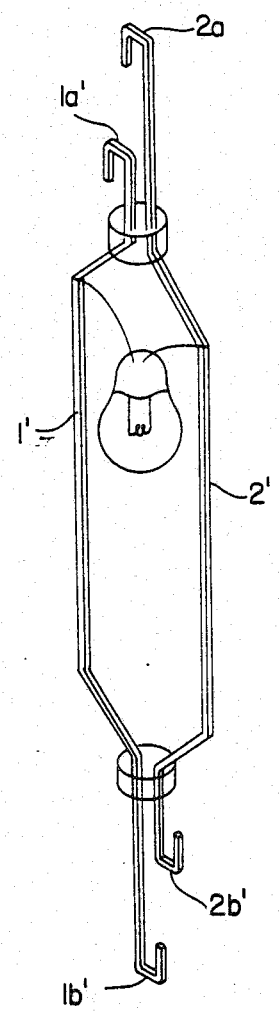
FIG. 15 is a view showing a seventh embodiment of this invention.

It should be noted further that, as shown in FIG. 14, it is possible to modify the illumination light of the decorative hanging lighting apparatus by covering the lighting unit with a transparent globe 9 or inserting a spacer 10 between lighting units. Further, as shown in FIG. 15, the two hooking members 1' and 2' may be formed in another shape in which their hooking means 1a' and 2a' and 1b' and 2b' are formed in a shape respectively symmetrically oppositely turned at top and bottom and being arranged at different levels.

Figure 16:
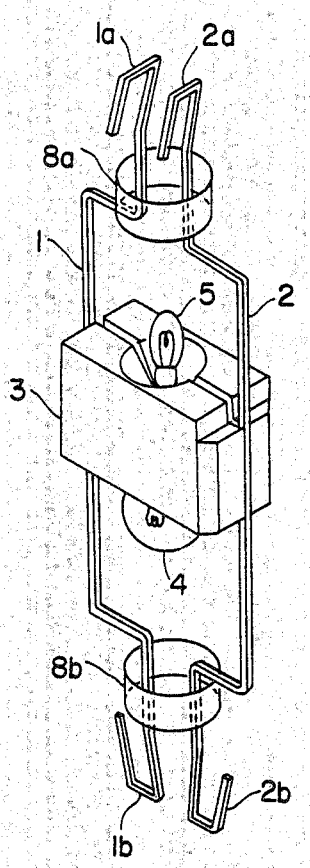
FIG. 16 is an appearance view of a lighting unit of a decorative hanging lighting apparatus, an eighth embodiment of this invention.

FIG. 16 is an appearance view of a single lighting unit of a decorative hanging lighting apparatus, an eighth embodiment of this invention.

Hooking members 1 and 2 of a conductor are securely held by insulating fixing members 8a and 8b in such a way as to be kept apart from each other. At both ends of each of these two hooking means 1 and 2, there are formed top hooking means 1a and 2a and bottom hooking means 1b and 2b. The distance between the aforementioned two hooking members 1 and 2 is widened between the top fixing member 8a and the bottom fixing member 8b. Between them, a lamp housing 3 of an insulator holding lamps 4 and 5 therein is vertically slidably arranged.

Figure 17A:
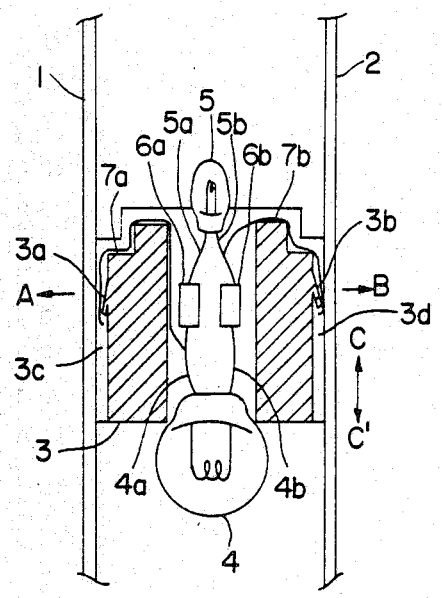
FIG. 17(A) is a sectional view of a lamp housing arranged in this lighting unit and FIG. 17(B) is a plan view of this lamp housing.
Figure 17B:
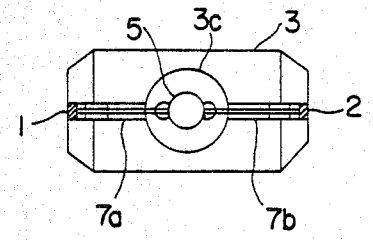

FIG. 17(A) is a sectional view showing the structure of the lamp housing arranged in the aforementioned lighting unit and FIG. 17(B) is a plan view of the aforementioned lamp housing.

The lamp housing 3 is formed in a box shape with an insulating material and at its center, there is arranged a hole part 3c not only for holding the lamps but for containing the wirings for electrodes as well. Further on the side surfaces of the lamp housing 3 facing the hooking members 1 and 2, there are formed groove parts 3d in which these hooking members fit. And on the inside of the aforementioned groove parts 3d, there are formed elastic protrusions 3a and 3b, which respectively urge towards the directions of the arrow marks A and B lead wires 7a and 7b which are extending from the aforementioned hole part 3C through the top surface of the lamp housing and exposed to the groove part 3d. In this way, the lead wires 7a and 7b are in frictional contact with the hooking members 1 and 2, so that the lamps 4 and 5 held in the lamp housing and the hooking members 1 and 2 are electrically connected. By dint of the frictional force between the lead wires and the hooking members which are produced by the elastic force respectively in the A and B directions of the aforementioned elastic protrusions 3a and 3b, it is made possible to hold the lamp housing 3 in an arbitrary position as well as slidably moving it in the directions of the arrow marks C and C' in the lighting unit.

Figure 18A:
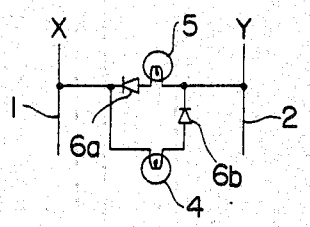
FIG. 18(A) is a wiring diagram of lamps held in the lamp housing, while FIGS. 18(B) and (C) are diagrams showing wirings for selectively lighting either one of two lamps held in this lamp housing.

FIG. 18(A) gives a wiring diagram for the lamps inside the aforementioned lamp housing.

Inside the lamp housing 3, to the electrode wire on the side of the hooking member 2 of a lamp 4, a diode 6b is linked, while to the electrode wire on the side of the hooking member 1 of another lamp 5, another diode 6a is associated. The aforementioned diodes are connected respectively in opposite directions.

Figure 18B:
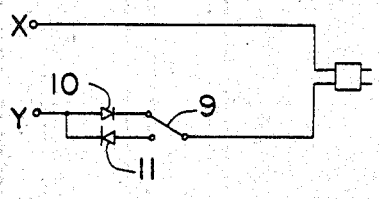

FIGS. 18(B) and (C) show wiring diagrams of power supply lines for selectively getting lit up one of the lamps held in the aforementioned lamp housing.

Figure 18C:
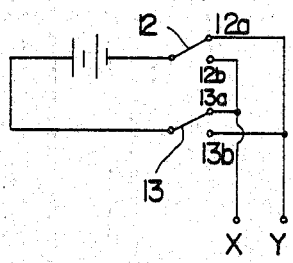

In employing an AC power source, as shown in FIG. 18(B), there are arranged a switch 9 in one of power supply lines and diodes 10 and 11 oppositely linked thereto. With this arrangement, as the switch 9 is connected to the diode 10 side, the lamp 4 shown in FIG. 18(A) is lit. Conversely, as the switch 9 is connected to the diode 11 side, the lamp 5 is lit. When using a DC power source, as shown in FIG. 18(C), while switches 12 and 13 are arranged respectively on both sides of the power source, both switches are interlocked, with one of contacts 12a on the switch 12 side linked to a contact 13b of the switch 13 which is not corresponding to the former and further, with a contact 12b joined to a contact 13a. With this arrangement, when the switches are operated to the side of the contacts 12a and 13a, the lamp 4 is lit and when they are operated to the side of the contacts 12b and 13b, the lamp 5 is lit. Thus by arranging the wiring as above described, it is possible to selectively get lit either one of two lamps 4 and 5.

Figure 19:
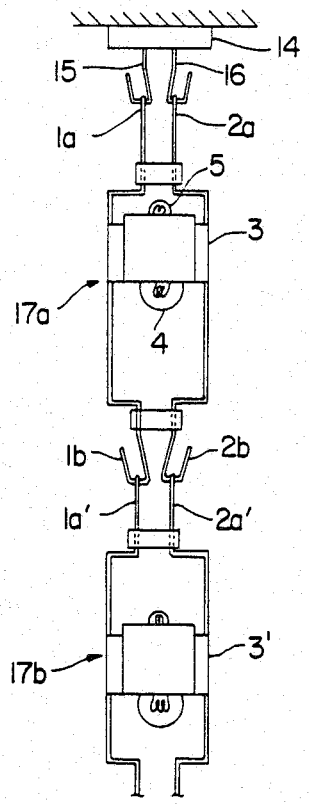
FIG. 19 is a view illustrating a construction of the aforementioned eighth embodiment.

FIG. 19 is a view illustrating a construction of a decorative hanging lighting apparatus using the aforementioned lighting units. To hooking means 15 and 16 of hooking fixture 14 attached to the ceiling, a voltage (about 12 V is considered appropriate) is supplied from a power supply line not shown in this figure. To the aforementioned hooking means 15 and 16, the light units 17a and 17b shown in FIG. 16 are coupled by hooking. With top hooking means 1a and 2a hooked on the hooking means 15 and 16, current is supplied to the lamp housing 3 of the lighting unit 17a, thereby getting lit up either one of two lamps 4 or 5 held in this lamp housing 3, while the source voltage is conduced also to the bottom hooking means 1b and 2b. Then, the current is supplied to the lamp housing 3' of the lighting unit 17*b* which is hooked on the bottom hooking means 1*b* and 2*b* through its top hooking means 1*a* and 2*a*. As hereabove described, the source voltage supplied to the hooking means 15 and 16 is conducted through hooking members of each lighting unit, to supply the current to lamp housings of all coupled lighting units, thereby enabling the lamps to be lit up.

As hereabove described, in this embodiment, by slidably arranging the lamp housing in each lighting unit, it is readily possible to adequately alter the distance between light sources and it is also possible to simply make image change of the illumination light, with two lamps installed in each lamp housing and one of them arranged to be selectively lightable.

Besides, it is also feasible to hold a single lamp in the lamp housing or to hold three or more lamps therein. Further, it is also practical to hold the lead wires and the hooking members in frictional contact to each other by making use of elastic protrusions of any other shapes.

INDUSTRIAL APPLICABILITIES

As hereabove described, the decorative hanging lighting apparatuses are useful when decorations by use of light are desired in indoor structures with ceilings, such as hotels' lobbies or common home parlors, etc.

What is claimed is:

1. A decorative hanging lighting apparatus adapted to be hung from the ceiling, and composed of a plurality of lighting units coupled together, characterized in that two hooking members each equipped with hooking means at both ends and formed of a conductor are provided in each of the aforementioned lighting units, electrode wires of an electric bulb are linked respectively to the aforementioned two hooking members and the top hooking means of one lighting unit are hooked on the bottom hooking means of the other lighting unit located just above the aforementioned lighting unit.

2. A decorative hanging lighting apparatus according to claim 1, wherein each aforementioned lighting unit is composed of at least two bulbs and is covered by a bell shape glass globe having opening parts at its top and bottom and at least one electrical bulb is located at the top opening part of the glass globe, while the other electric bulb is placed inside the glass globe.

3. A decorative hanging lighting apparatus according to claim 2, wherein diodes are inserted in opposite directions to each other in the respective electrode wires of the electric bulb located in the top opening part of the aforementioned glass globe and the electric bulb placed inside the glass globe.

4. A decorative hanging lighting apparatus according to claim 1, wherein the aforementioned electric bulb is mounted on an insulating sliding plate which is vertically slidable along the aforementioned two hooking members, and on the aforementioned sliding plate there are arranged conductors which are connected to the electrode wires of the electric bulb and which are in contact with the aforementioned two hooking members.

5. A decorative hanging lighting apparatus according to claim 1, wherein the top and the bottom hooking means of each of the aforementioned two hooking members are so configured as to be placed on a common plane and moreover, the hooking means are vertically shifted one from the other, while keeping them still so arranged that respective hooking means are in a common plane.

6. A decorative lighting apparatus according to claim 1, wherein each of the aforementioned electric bulbs is mounted in a lamp housing provided with grooves which vertically slidably fit on the aforementioned two hooking members, and on the aforementioned lamp housing there are disposed lead wires which are joined to the electrode wires of the electric bulb and which are in contact with the aforementioned two hooking members in the aforementioned grooves.

7. A decorative hanging lighting apparatus adapted to be hung from the ceiling according to claim 1 wherein the decorative hanging lighting apparatus is connected to a twelve volt source of power.

* * * * *